US010823179B2

(12) United States Patent
Venkatachalam et al.

(10) Patent No.: US 10,823,179 B2
(45) Date of Patent: Nov. 3, 2020

(54) METHOD OF ASSEMBLING A SET OF IMPELLERS THROUGH TIE RODS IMPELLER AND TURBOMACHINE

(71) Applicant: Nuovo Pignone Srl, Florence (IT)

(72) Inventors: Kalyan Kumar Venkatachalam, Karnataka (IN); Lakshmanudu Kurva, Karnataka (IN); Manuele Bigi, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 368 days.

(21) Appl. No.: 15/104,581

(22) PCT Filed: Dec. 16, 2014

(86) PCT No.: PCT/EP2014/077894
§ 371 (c)(1),
(2) Date: Jun. 15, 2016

(87) PCT Pub. No.: WO2015/091436
PCT Pub. Date: Jun. 25, 2015

(65) Prior Publication Data

US 2016/0319820 A1 Nov. 3, 2016

(30) Foreign Application Priority Data

Dec. 18, 2013 (IT) ..... CO2013A0071

(51) Int. Cl.
*F01D 5/06* (2006.01)
*F04D 17/12* (2006.01)
(Continued)

(52) U.S. Cl.
CPC ..... *F04D 17/122* (2013.01); *F01D 5/066* (2013.01); *F04D 29/054* (2013.01);
(Continued)

(58) Field of Classification Search
CPC ..... F04D 17/12; F04D 17/122; F04D 1/06; F04D 1/066; F04D 29/054; F04D 29/266;
(Continued)

(56) References Cited

U.S. PATENT DOCUMENTS 3,184,153 A 5/1965 Zech
3,749,516 A 7/1973 Samurin et al.
(Continued)

FOREIGN PATENT DOCUMENTS

CH 341030 A 9/1959
DE 2844746 A1 * 4/1979 ..... F01D 5/066
(Continued)

OTHER PUBLICATIONS

Machine Translation of DE 2844746 A1.*
(Continued)

*Primary Examiner* — Richard A Edgar
*Assistant Examiner* — Elton K Wong
(74) *Attorney, Agent, or Firm* — Baker Hughes Patent Organization

(57) ABSTRACT

A set of impellers that are axially adjacent to each other and that have respective axial through holes are assembled. At least a first and a second axial tie rods are used. At least one connection element being axially adjacent to two impellers respectively at its two sides and having an axial through hole is provided. The connection element is used for securing, at one side of its axial through hole, an end of the first axial tie rod and, at the other side of its axial through hole, an end of the second axial tie rod. Typically, the connection element is one of the impellers of the set.

7 Claims, 5 Drawing Sheets

(51) Int. Cl.
*F04D 29/62* (2006.01)
*F04D 29/054* (2006.01)
*F04D 29/056* (2006.01)

(52) U.S. Cl.
CPC ..... *F04D 29/056* (2013.01); *F04D 29/624* (2013.01); *F05D 2230/51* (2013.01)

(58) Field of Classification Search
CPC ..... F04D 29/285; F04D 29/286; F01D 5/025; F01D 5/06; F01D 5/066; F01D 1/22; F05D 2230/51
USPC ..... 416/244 R, 244 A
See application file for complete search history.

(56) References Cited

U.S. PATENT DOCUMENTS

| | | | | |
|---|---|---|---|---|
| 5,796,202 | A | 8/1998 | Herron et al. | |
| 2013/0251531 | A1* | 9/2013 | Yagi | F04D 29/20 416/192 |
| 2015/0322961 | A1* | 11/2015 | Slotman | F01D 5/066 415/198.1 |

FOREIGN PATENT DOCUMENTS

| | | | |
|---|---|---|---|
| DE | 4128673 | C1 | 8/1991 |
| DE | 4128673 | C1 | 8/1992 |
| JP | S61-291800 | A | 12/1986 |
| JP | H10-205482 | A | 8/1998 |
| JP | 2006138255 | A | 6/2006 |
| RU | 2 551 453 | C2 | 5/2015 |

OTHER PUBLICATIONS

International Search Report and Written Opinion issued in connection with corresponding PCT application PCT/EP2014/077894 dated Feb. 19, 2015.

Machine Translation Notification of reasons for refusal issued in connection with corresponding JP Application No. 2016-540027 dated Oct. 30, 2018.

Decision to Grant issued in connection with corresponding RU Application No. 2016122900 dated Jul. 2, 2018.

* cited by examiner

METHOD OF ASSEMBLING A SET OF IMPELLERS THROUGH TIE RODS IMPELLER AND TURBOMACHINE

TECHNICAL FIELD

Embodiments of the subject matter disclosed herein relate to methods of assembling a set of impellers, impellers and turbomachines.

BACKGROUND

Assembling of a set of impellers may be done in different ways.

One way of assembling a set of impellers consists in providing axial through holes in the impellers, placing all the impellers axially adjacent to each other, inserting an axial tie rod in the holes so that it protrudes both from the first impeller and from the last impeller, and applying axial forces on the first impeller and last impeller by means of the tie rod to tightly hold all the impellers together.

Such a method for assembling a set of impellers is simple and effective, but it has some drawbacks.

When the impeller assembly heats up due to the operation of the machine and due to the fluid in contact with the impellers, the tie rod also heats up and loosens the impellers somewhat, which may cause relative rotations of the impellers and/or unbalance of the rotor and/or high vibrations of the machine and/or low power generation/absorption and/or fretting and wear of the connections between impellers. This drawback is proportional to the number of impellers and to the length of the tie rod. This drawback depends on the temperatures of the tie rod and of the impellers during the operation of the machine. This drawback also depends on the materials used for the tie rod and for the impellers in particular because of the different thermal expansion coefficients for different materials.

When the tie rod is long, damping devices need to be associated to the axial tie rod and placed at some points between its two ends, or in other words, inside the axial holes of the impellers. Such damping devices are subject to wear and/or damage and so they can reduce the reliability of the machine using them; furthermore, as such damping devices are located inside the impeller axial holes, their maintenance operation requires complete disassembling of the machine. Therefore, there is a need for an improved way of assembling a set of impellers.

BRIEF DESCRIPTION

In an embodiment, a method for an improved way of assembling a set of impellers generally involves use of a plurality of axial tie rods, such as two or three or four.

A first aspect of the present invention is an impeller. The impeller of a turbomachine includes an axial through hole, a first portion with a first axial hole having a first cross-section, and a second portion with a second axial hole having a second cross-section. In this aspect, the first cross-section is smaller than the second cross-section, and the first and second axial holes constitute the axial through hole. Additionally, the first portion is coupleable to an end of a first axial tie rod and the second portion is coupleable to an end of a second axial tie rod.

A second aspect of the present invention is a turbomachine. The turbomachine includes at least one impeller comprising an axial through hole (6B), wherein at least one impeller has a first portion with a first axial hole having a first cross-section and a second portion with a second axial hole having a second cross-section. The first cross-section is smaller than the second cross-section, and the axial through hole includes the first and second axial holes. At least a first and a second axial tie rods are located at least in part inside the axial through holes. Additionally, there is at least one nut, and the at least one impeller is coupled to an end of the first axial tie rod by means of the nut and is directly coupled to an end of the second axial tie rod.

A third aspect of the present invention is a method of assembling a set of impellers. The method is used for assembling a rotor for a turbomachine and includes the steps of providing a plurality of impellers having respective axial through holes; disposing the impellers axially adjacent to each other; providing at least a first and a second axial tie rods; providing at least one connection element; and using the connection element for securing, at one side of its axial through hole, an end of the first axial tie rod and, at the other side of its axial through hole, an end of the second axial tie rod.

BRIEF DESCRIPTION OF THE DRAWINGS

The accompanying drawings, which are incorporated herein and constitute a part of the specification, illustrate exemplary embodiments of the present invention and, together with the detailed description, explain these embodiments. In the drawings.

DETAILED DESCRIPTION

The following description of exemplary embodiments refers to the accompanying drawings.

The following description does not limit embodiments of the present invention. Instead, the scope of the embodiments of the present invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
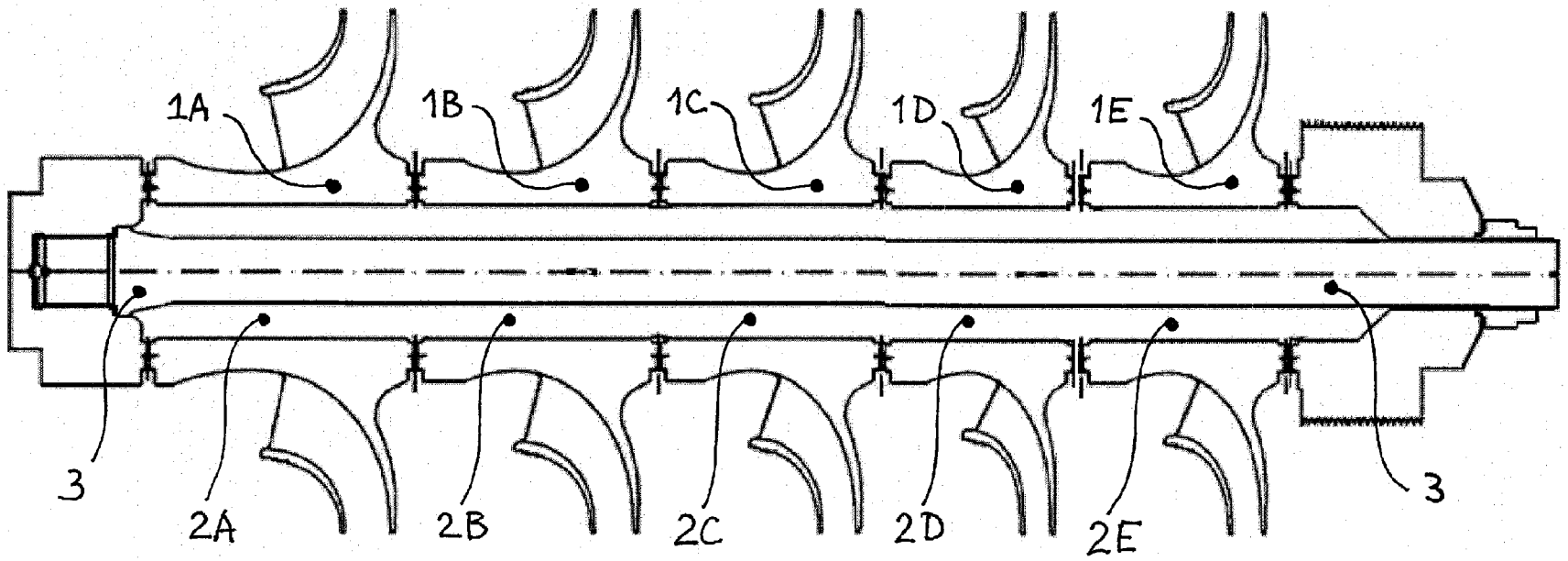
FIG. 1 shows a simplified cross-section view of a set of impellers assembled through only one axial tied rod.

FIG. 1 shows a set of five impellers 1A, 1B, 1C, 1D, 1E of a centrifugal compressor that is a five-stage centrifugal compressor. Impellers 1A, 1B, 1C, 1D, 1E are axially adjacent to each other and have respective axial through holes 2A, 2B, 2C, 2D, 2E; in particular, these holes are, for example, cylindrical and have the same diameter. Axial through holes 2A, 2B, 2C, 2D, 2E are axially aligned and a single axial tie rod 3 is inserted in these holes so that it protrudes (at least somewhat) both from the first impeller 1A and from the last impeller 1E. Axial forces are applied on the first impeller 1A and last impeller 1E by means of the tie rod 3 (as well as of two elements, according to this embodiment) to tightly hold all the impellers 1A, 1B, 1C, 1D, 1E together.

Figure 2:
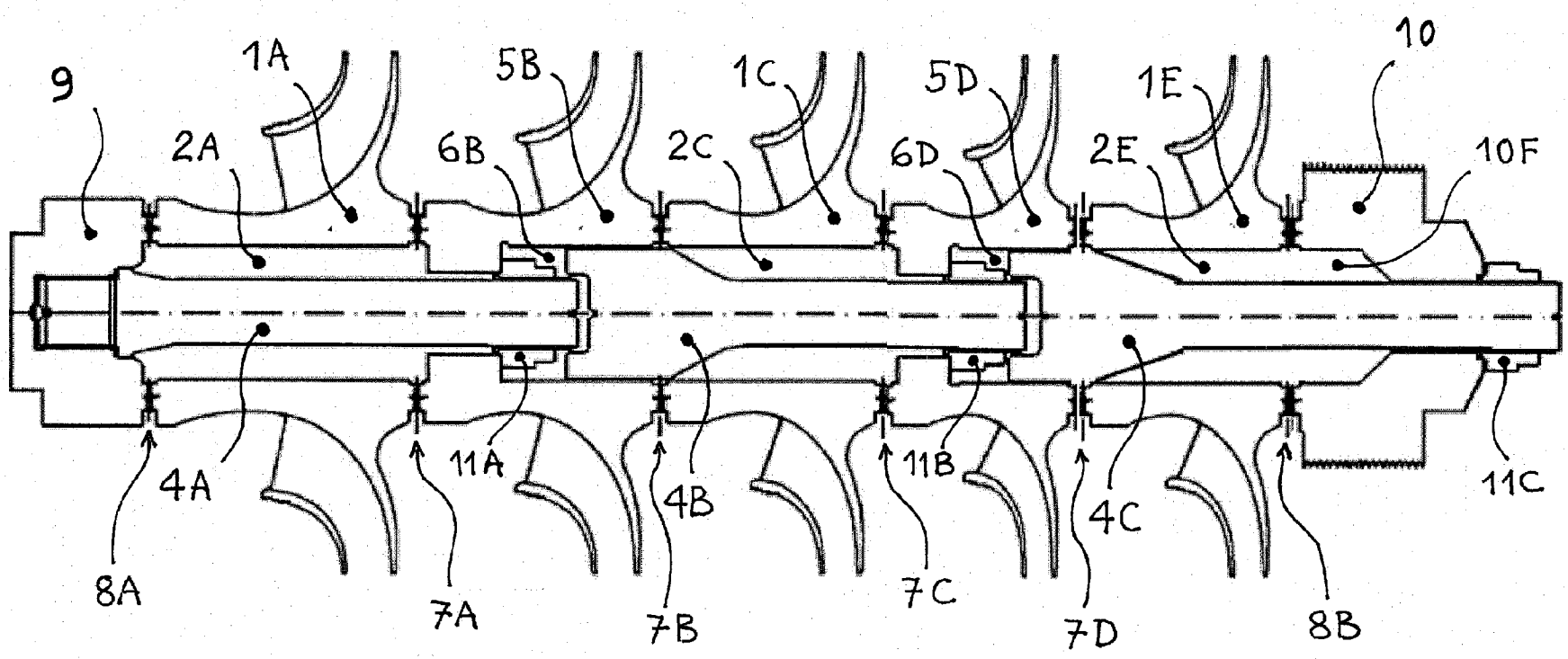
FIG. 2 shows a simplified cross-section view of a set of impellers assembled through three axial tied rods.

FIG. 2 shows an arrangement similar to that of FIG. 1, but wherein three axial tie rods 4A, 4B, 4C are used to tightly hold all the five impellers together, namely 1A, 5B, 1C, 5D, 1E. The first impeller (i.e. impeller 1A), the central impeller (i.e. impeller 1C) and the last impeller (i.e. impeller 1E) of this embodiment of FIG. 2 are identical to those of the embodiment of FIG. 1.

The second impeller 5B is shaped so that tie rod 4A tightly holds the first impeller 1A and the second impeller 5B together; the fourth impeller 5D is shaped so that tie rod 4B tightly holds the second impeller 5B and the third impeller 1C and the fourth impeller 5D together; the fourth impeller 5D and the fifth impeller 1E are held together by tie rod 4C through a further element 10 that will be described later on.

According to this embodiment, each axial tie rod is used to hold together (for example) two or three impellers only and not all of them; therefore, the risk of loosening the impellers and the need of dampers for the tie rods are much reduced.

In general, the assembling of a set of impellers is realized through at least one connection element that is axially adjacent to two impellers respectively at its two sides and that has an axial through hole; the connection element is used for securing, at one side of its axial through hole, an end of a first axial tie rod and, at the other side of its axial through hole, an end of a second axial tie rod.

Figure 4:
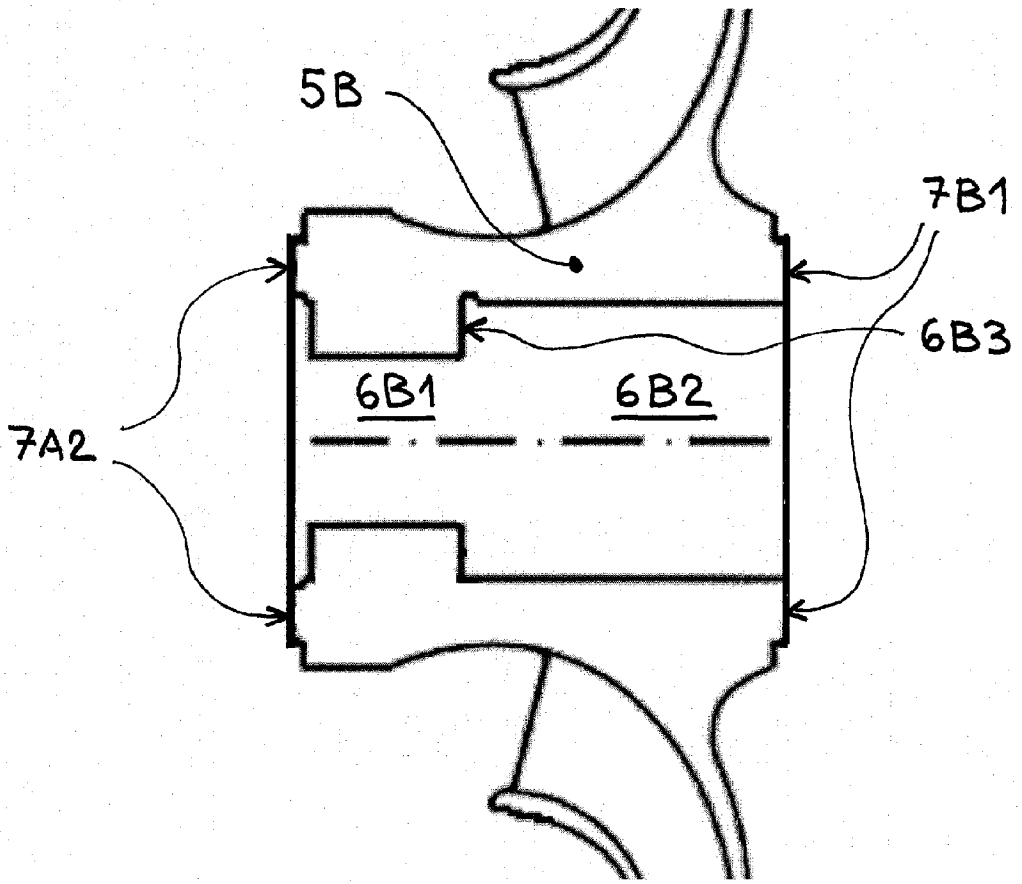
FIG. 4 shows a simplified and partial cross-section view of an impeller having a shaped axial through hole.

In an embodiment, the connection element is one of the impellers of the set to be assembled; in the embodiment of FIG. 2, impellers 5B and 5D act also as connection elements and are very similar to each other; FIG. 4 shows in detail impeller 5B, by way of example, with its axial through hole 6B.

In an embodiment, one of the impellers is at least part of the connection element.

In an embodiment, the impellers 1A, 5B, 1C, 5D, 1E of the set are tangentially coupled to each other by respective hirth joints 7A, 7B, 7C, 7D located around their axial through holes 2A, 6B, 2C, 6D, 2E; hirth joints assure a very good coupling and allow exactly the same reciprocal position of the impellers even after several assembling and disassembling operations (due to e.g. maintenance).

Figure 5:
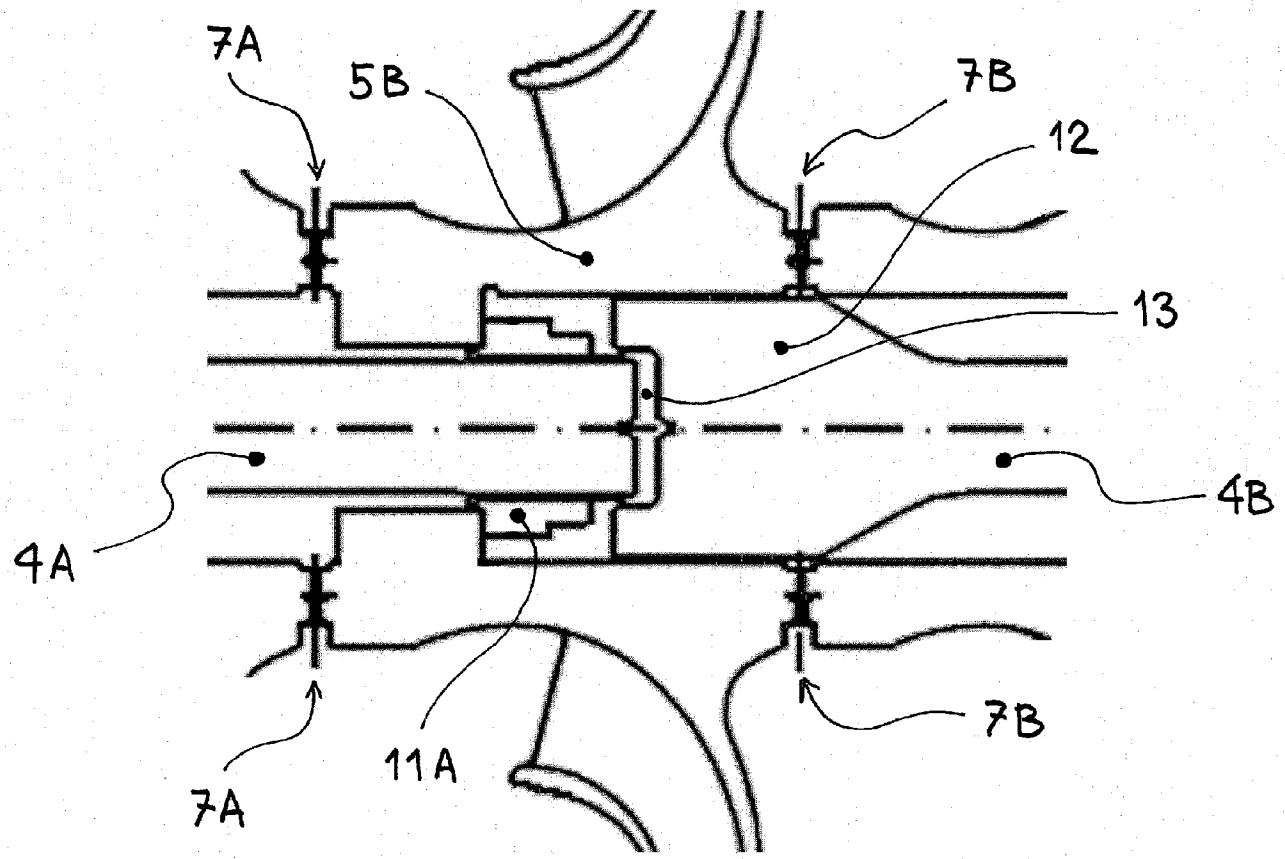
FIG. 5 shows the impeller of FIG. 4 as it is used in the arrangement of FIG. 2.

Impeller 5B includes an axial through hole 6B; a first hole portion 6B1 of the axial through hole is located at a first side of the impeller and has a first cross-section; a second hole portion 6B2 of the axial through hole is located at a second side of the impeller and has a second cross-section; the first side is opposite to the second side; the first cross-section (see 6B1) is smaller than the second cross-section (see 6B2); the first hole portion 6B1 may be used as reference for tie rod 4A centering through nut 11A. A flat surface 6B3 connects the internal surfaces of the first and second hole portions 6B1 and 6B2 and is adapted to be coupled to an end of an axial tie rod; FIG. 5 shows surface 6B3 coupled to a nut 11A of axial tie rod 4A. The second hole portion 6B2 is adapted to be coupled to an end of another axial tie rod; FIG. 5 shows axial tie rod 4B screwed in hole portion 6B2 (that is threaded); in particular, there is a threaded shank of an enlarged (specifically radially enlarged) end 12 of the axial tie rod 4B. The enlarged end 12 of axial tie rod 4B has a recess 13 (specifically an axial recess) for housing an end (specifically the tip of the end) of axial tie rod 4A; in this way, a very good connection may be achieved in a smaller axial length still allowing precision assembly and tightening. It is to be noted that a partial or total wall may be placed between hole portions 6B1 and 6B2.

Impeller 5B is provided with teeth 7A2 of a first hirth joint 7A located around axial through hole 6B at a first side of the impeller, and teeth 7B1 of a second hirth joint 7B located around axial through hole 6B at a second side of the impeller.

Figure 3:
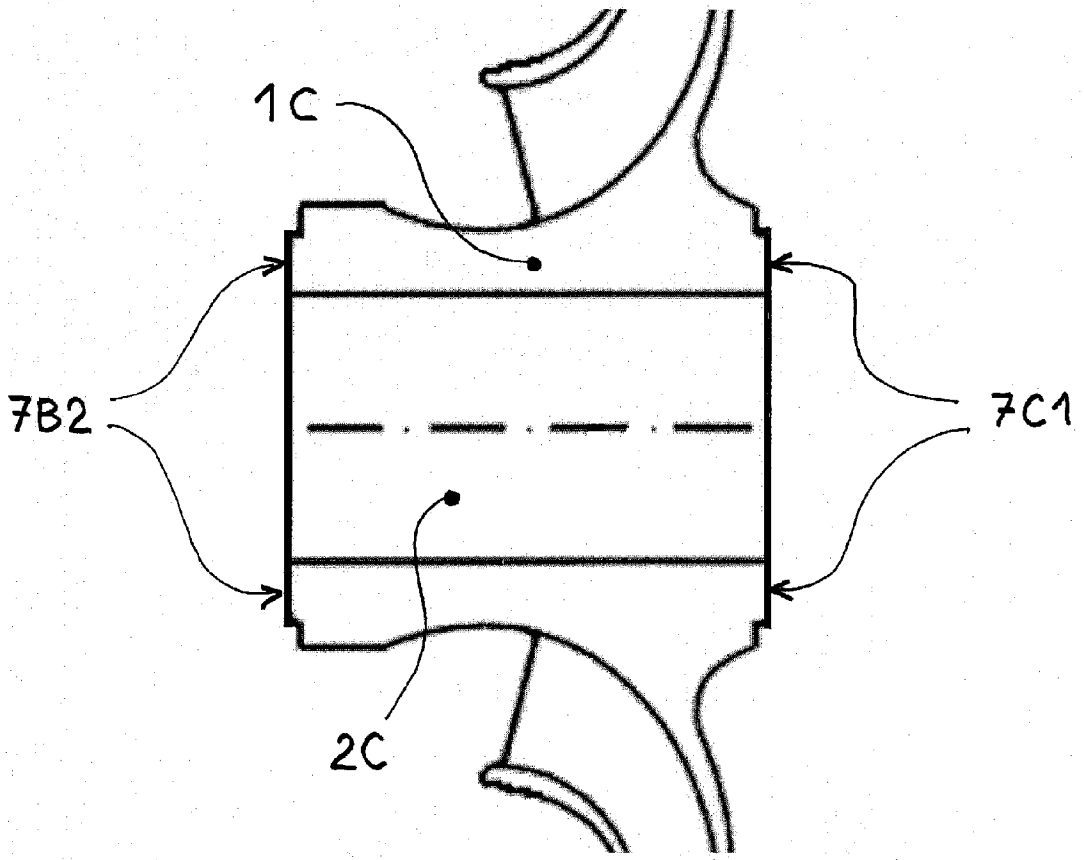
FIG. 3 shows a simplified and partial cross-section view of an impeller having a simple axial through hole.

FIG. 3 shows an embodiment of impeller of the set to be assembled that does not act as connection element; impellers 1A, 1C and 1E are very similar to each other. Impeller 1C has an axial through hole 2C that is, for example, cylindrical. Impeller 1C is provided with teeth 7B2 of a second hirth joint 7B located around axial through hole 2C at a first side of the impeller, and teeth 7C1 of a third hirth joint 7C located around axial through hole 2C at a second side of the impeller.

According to the embodiment of FIG. 2, the axial tie rods 4A, 4B, 4C are arranged in series; the first axial tie rod 4A of the serial arrangement is connected to an element 9 acting as head for tensioning the axial tie rod 4A and located in front of the first impeller 1A of the set. For example, an end of tie rod 4A is screwed in a threaded hole of element 9, and element 9 is connected to impeller 1A by means of a hirth joint 8A.

According to the embodiment of FIG. 2, the axial tie rods 4A, 4B, 4C are arranged in series; the last axial tie rod 4C of the serial arrangement is coupled to an element 10 through a nut 11C of the tie rod 4C; element 10 is axially adjacent to the last impeller 1E at one of its sides and has an axial through hole 10F (specifically a shaped hole) for receiving the last axial tie rod 4C. For example, element 10 is connected to impeller 1E by means of a hirth joint 8B.

It is to be noted that elements 9 and 10 may have different shapes and sizes; in particular, they could include journal bearings, shaft end seals, balance drums, thrust collars. Assembling of the arrangement of FIG. 2 is carried out gradually and for example as follows:

- rod 4A is fixed to element 9,
- rod 4A is inserted in hole 2A of impeller 1A till coupling of joint 8A,
- rod 4A is inserted in hole 6B of impeller 5B till coupling of joint 7A,
- nut 11 A is screwed on rod 4A till it is tightened,
- rod 4B is screwed in hole 6B till it is tightened,
- rod 4B is inserted in hole 2C of impeller 1C till coupling of joint 7B,
- rod 4B is inserted in hole 6D of impeller 5D till coupling of joint 7C,
- nut 11 B is screwed on rod 4B till it is tightened,
- rod 4C is screwed in hole 6D till it is tightened,
- rod 4C is inserted in hole 2E of impeller 1E till coupling of joint 7D,
- rod 4C is inserted in hole 10F of element 10 till coupling of joint 8B,
- nut 11 C is screwed on rod 4C till it is tightened.

At this point the arrangement is fully assembled.

It is to be noted that the above description of the assembling procedure is not intended to specify which parts are moved and which parts are maintained stationary.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A turbomachine comprising:

at least one impeller comprising an axial through hole, wherein the at least one impeller has a first portion with a first axial hole having a first cross-section, and a second portion with a second axial hole having a second cross-section, wherein the first cross-section is smaller than the second cross-section, and the axial through hole comprises the first and second axial holes;

at least a first and a second axial tie rod located at least in part inside the axial through hole;

at least one nut, wherein the at least one impeller, with the at least one nut, is coupled to an end of the first axial tie rod, and the at least one impeller is directly coupled to an end of the second axial tie rod.

2. The turbomachine of claim 1, wherein at least one of the axial tie rods has an enlarged end screwed in the second portion of the at least one impeller.

3. The turbomachine of claim 2, wherein the enlarged end of the at least one of the axial tie rods has a recess for housing an end of another axial tie rod.

4. The turbomachine of claim 1, wherein the at least first and second axial tie rods are arranged in series, wherein one of the at least first and second axial tie rods is connected to a tensioning element configured to tension the one of the at least first and second axial tie rods, the tensioning element located in front of an impeller of a set of impellers, the set of impellers including the at least one impeller.

5. The turbomachine of claim 4, wherein one of the at least first and second axial tie rods is coupled to an element, the element being axially adjacent to an impeller of the set of impellers and has and having an axial through hole to receive another of the at least first and second axial tie rods.

6. The turbomachine of claim 1, wherein the turbomachine is a multi-stage centrifugal compressor.

7. The turbomachine of claim 1, wherein the at least one impeller comprises a first hirth joint and a second hirth joint, wherein the first hirth joint comprises teeth that are located around the axial through hole at a first side of the at least one impeller, and the second hirth joint comprises teeth that are located around the axial through hole at a second side of the at least one impeller.

* * * * *